United States Patent [19]

Radenkovich et al.

[11] Patent Number: 4,475,062

[45] Date of Patent: Oct. 2, 1984

[54] ECONOMY DEVICE FOR FLUORESCENT LIGHTING FIXTURES

[76] Inventors: Michael Radenkovich; Milorad L. Milosevic, both of P.O. Box 1617, Santa Monica, Calif. 90406

[21] Appl. No.: 598,358

[22] Filed: Apr. 11, 1984

Related U.S. Application Data

[63] Continuation of Ser. No. 375,537, May 6, 1982, abandoned.

[51] Int. Cl.[3] ..... H05B 39/10

[52] U.S. Cl. ..... 315/88; 315/90; 315/177; 315/283; 315/324

[58] Field of Search ..... 315/88, 90, 177, 283, 315/324

[56] References Cited

U.S. PATENT DOCUMENTS

| | | | |
|---|---|---|---|
| 3,701,925 | 10/1972 | Nozawa et al. | 315/105 |
| 3,754,160 | 8/1973 | Jensen et al. | 315/257 |
| 4,006,384 | 2/1977 | Elms et al. | 315/324 |
| 4,079,292 | 3/1978 | Kaneda | 315/289 |
| 4,339,695 | 7/1982 | Siglock | 315/289 |
| 4,353,009 | 10/1982 | Knoll | 315/224 |

*Primary Examiner*—Harold Dixon
*Attorney, Agent, or Firm*—Edward D. C. Bartlett

[57] ABSTRACT

A device is disclosed for converting fluorescent lighting fixtures, having a conventional series-type ballast with at least two lamps, to effect illumination of only one of the two lamps at a time, but automatically effecting illumination of the other lamp upon that one becoming disabled. The device includes an induction coil to increase the starting boost available to one of the two lamps and also has a varistor. The varistor may be connected across a secondary coil of the ballast which is then arranged to idle. With fixtures having two pairs of instant-start lamps, the varistor is instead connected to an electrode of one lamp of each pair. The device preferably has a series circuit comprising the varistor, the inductive coil, a capacitor and a resistor. Preferably four electrical connections, two across the varistor and two across the inductive coil, are provided to connect the device into the circuitry of the ballast and lamps. The device lengthens the effective life of the lamps, provides a softer but adequate amount of illumination, and effects a significant energy saving.

11 Claims, 7 Drawing Figures

ECONOMY DEVICE FOR FLUORESCENT LIGHTING FIXTURES

This is a continuation of application Ser. No. 375,537, filed May 6, 1982, now abandoned.

FIELD OF THE INVENTION

This invention relates to an economy device for fluorescent lighting fixtures which have one or more pairs of electric discharge lamps. The invention also relates to lighting fixtures incorporating such device.

BACKGROUND OF THE INVENTION

Multi-fluorescent lamp fixtures usually have one or two pairs of lamps with each pair of lamps being ignited and operated by a series-type ballast.

The fluorescent lamps are usually elongate glass envelopes filled with some inert gas such as argon, krypton, or a mixture of inert gases and may have several drops of mercury in the envelope. The inside surface of the glass envelope is coated with phosphors which are capable of fluorescing when activated by ultraviolet radiation. This radiation is produced when the gas within the envelope is ionized. These fluorescent lamps have a negative resistance characteristic and require a higher voltage to start the arc or discharge than is required to maintain the discharge. When a voltage high enough is applied across a fluorescent lamp, the discharge occurs and the impedance of the lamp substantially reduces. As is well known, it is necessary to include in the lamp's circuit a current limiting impedance to prevent the current drawn by the lamp increasing to too high a value.

Also, as is well known, fluorescent lamps usually operate from a source of alternating current supply, and have the ballast in the circuitry for starting and lighting the lamps. The ballast serves as a step-up transformer to raise line voltage to values which will ignite the lamps. The ballast usually has secondary coils loosely coupled with a primary coil so that on open circuit the greatest portion of the transformer step-up voltage is available for ignition without loading the line, but upon ignition, when current flows in the secondary coils, high leakage reactance occurs and provides the impedance necessary to limit the current flow through the lamps while providing a lower operating voltage. Preferably the ballast operates at a high power factor which may be somewhat lagging. Various arrangements are employed to correct for power factor since the winding inductance causes lagging current.

One major disadvantage with multi-lamp fixtures is that when one of a pair of lamps fails, the remaining lamp of the pair cannot be re-ignited so that both lamps then remain unlit. This is due to the ballast circuit being unbalanced by the failure of the one lamp and then not having sufficient power available to re-ignite the other lamp. Not only does this limit the length of the life of the pair of lamps to that of the shorter life of the two, but also due to practical expediency, necessitates both lamps being replaced at the same time so that a lamp with some useful life remaining is discarded.

Another disadvantage is that when one lamp of a pair has failed, the other will start flickering if ambient temperature is 60° F. or above as it tries to discharge, and this creates excess loading on the ballast tending to shorten the useful life thereof.

SUMMARY OF THE INVENTION

It is an object of the present invention to provide an arrangement whereby only one in each pair of fluorescent lamps in a lighting fixture lights at a time, and when one in the pair fails the other lamp will ignite automatically.

A feature by which this is achieved, is to alter the normal wiring connections to the lamps from a standard commercially available ballast, and connect a device having an inductive coil and a varistor, and preferably a resistor and capacitor, to the ballast and to the lamps whereby sufficient energy can be made available from the so modified ballast circuit to ignite either lamp, but not both lamps, in each pair of lamps.

This has the advantage that both lamps of a pair attain their full useful life, this combined life being significantly greater than the normal life of the pair when simultaneously illuminated. It has been found that the light emitted in accordance with the invention is "softer" and apparently more than half the light effectively emitted by both lamps when illuminated as a pair in the lighting fixture. Such lighting has been found highly satisfactory in offices and commercial buildings and results in a significant energy saving over normal multi-lamp installations.

Accordingly, therefore, there is provided by the present invention a device for converting a fluorescent lighting fixture having a conventional series-type ballast and at least two lamps to effect illumination of only one of the two lamps at a time, but automatically effecting illumination of the other lamp upon that one becoming disabled, the device having an induction coil to increase the starting boost available to one of the two lamps, and having a varistor. The varistor may be connected across a secondary coil of the ballast which is then arranged to idle during illumination of the fixture, the varistor arresting transient surges occurring in the idling secondary coil.

Preferably, the device has a series circuit comprising the varistor, a capacitor and a resistor. The inductive coil is connected to form part of this series circuit. Preferably the resistor and capacitor are connected across the varistor and inductive coil.

For lighting fixtures having two pairs of instant-start lamps, the varistor is preferably connected to an electrode of one lamp of each pair instead of being connected across a secondary ballast coil.

The device preferably has four electrical connections for connecting it into the circuitry of the ballast and lamps, two such connections may be across the varistor and the other two across the inductive coil.

The device can advantageously be connected to suppress high voltage surges in the ballast, provide starting energy boost for a secondary coil of the ballast, and feed back high harmonics occurring between the electrodes of the lamps.

Other objects, features and advantages of the present invention will become more fully apparent from the following detailed description of the preferred embodiments, the appended claims and the accompanying drawings.

DETAILED DESCRIPTION OF SPECIFIC EMBODIMENTS

The preferred embodiments of the present invention are illustrated by way of example in FIGS. 3 to 7. However, before describing these preferred embodiments, prior art arrangements to which they relate will be described with reference to FIGS. 1 and 2.

Prior Art

Figure 1:
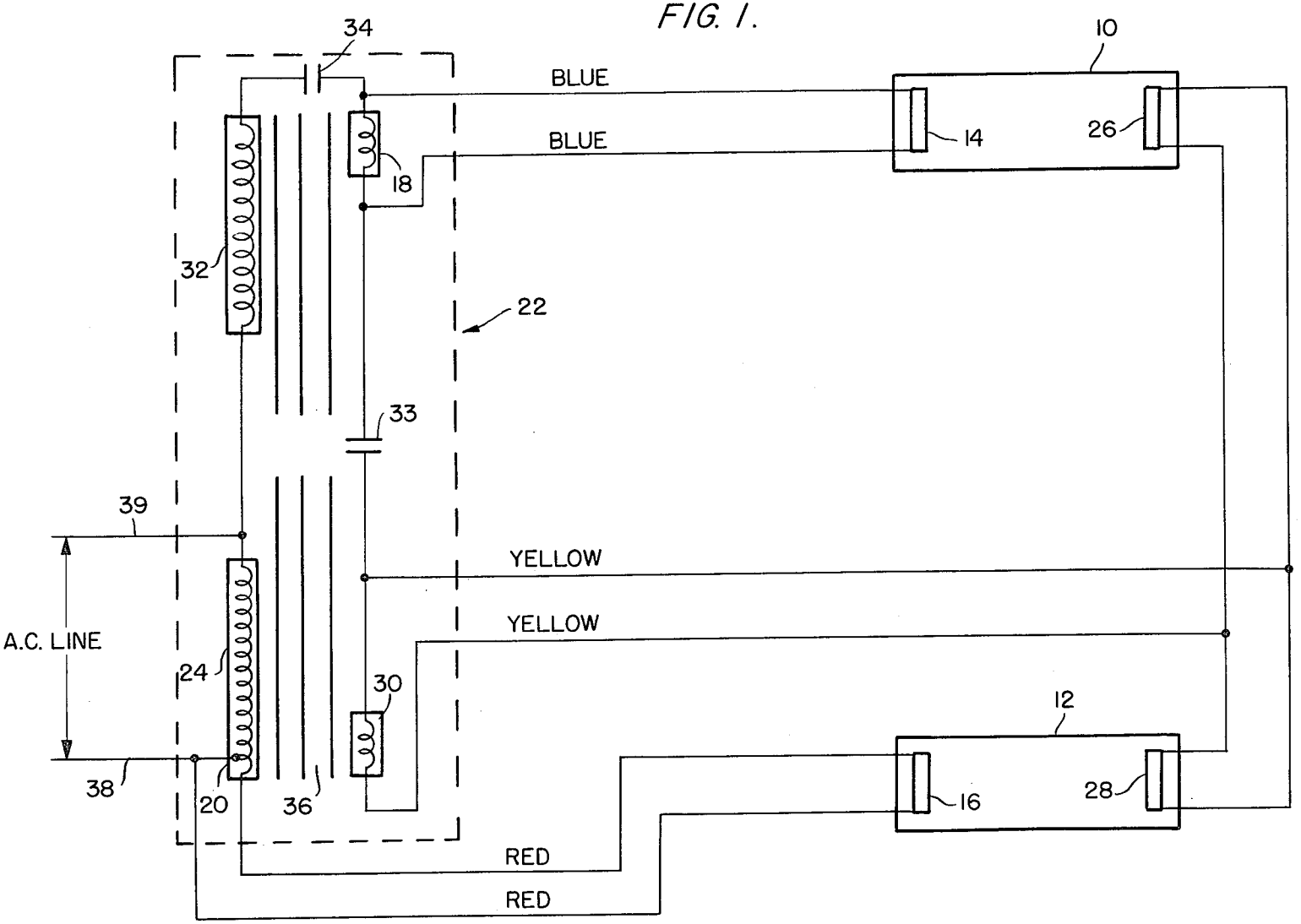
FIG. 1 is a schematic circuit diagram of a commercially available ballast connected in a two lamp fluorescent lighting fixture employing rapid-start type lamps.

FIG. 1 shows a typical, rapid-start fluorescent lighting fixture having a pair of rapid-start fluorescent lamps 10,12 having cathodes 14,16 which are individually heated by 3 to 4 volt cathode coils 18,20, respectively, of a conventional two lamp rapid-start ballast 22 for starting the lamps in sequence, and then operating them in series. The heating coil 20, is formed as an extension of the primary coil 24. The remaining, opposing cathodes 26,28 of the lamps 10,12 are heated, in parallel, off another low voltage cathode coil 30 of the ballast. A secondary coil 32 of the ballast, in auto-transformer relationship to the primary coil 24, provides high voltage to operate the lamps 10,12 in series. A flux leakage path is generally provided between the primary winding 24 and the secondary winding 32. A starting capacitor 33 is wired, in series, with the cathode coils 18,30, to help in the initial arcing of the lamps when voltage is first applied across them. A second capacitor 34 wired, in series, with the secondary coil 32 and the cathode 14 of the first lamp 10, serves primarily to limit the flow of electrical current to the lamps to a specified value. The primary coil 24 is mounted on a laminated iron core 36, inductively coupled to the secondary coil 30, and supplied via leads 39,38 from a source of alternating current such as conventional 60 cycle, 120-volt house supply. The secondary coil 32 is mounted on another laminated iron core 37 and inductively coupled to the secondary coil 18. The voltage across the lamps is 110 to 130 volts. The ballast 22, as represented by the enclosed broken-line box, is conventionally encapsulated and sealed in a metal container with four pairs of leads extending therefrom. The pairs of leads in FIG. 1 have been marked with the color code conventionally employed by ballast manufacturers. Such a ballast is manufactured and sold by Advance Transformer Co. of Chicago, Ill. under the name ADVANCE, catalogue number ROM-2S40-3TP.

With this conventional lighting arrangement, the lamps 10,12 operate in series, and if one of the lamps fails there is not sufficient starting power available from the ballast to re-ignite the remaining lamp which consequently also remains unlit.

Figure 2:
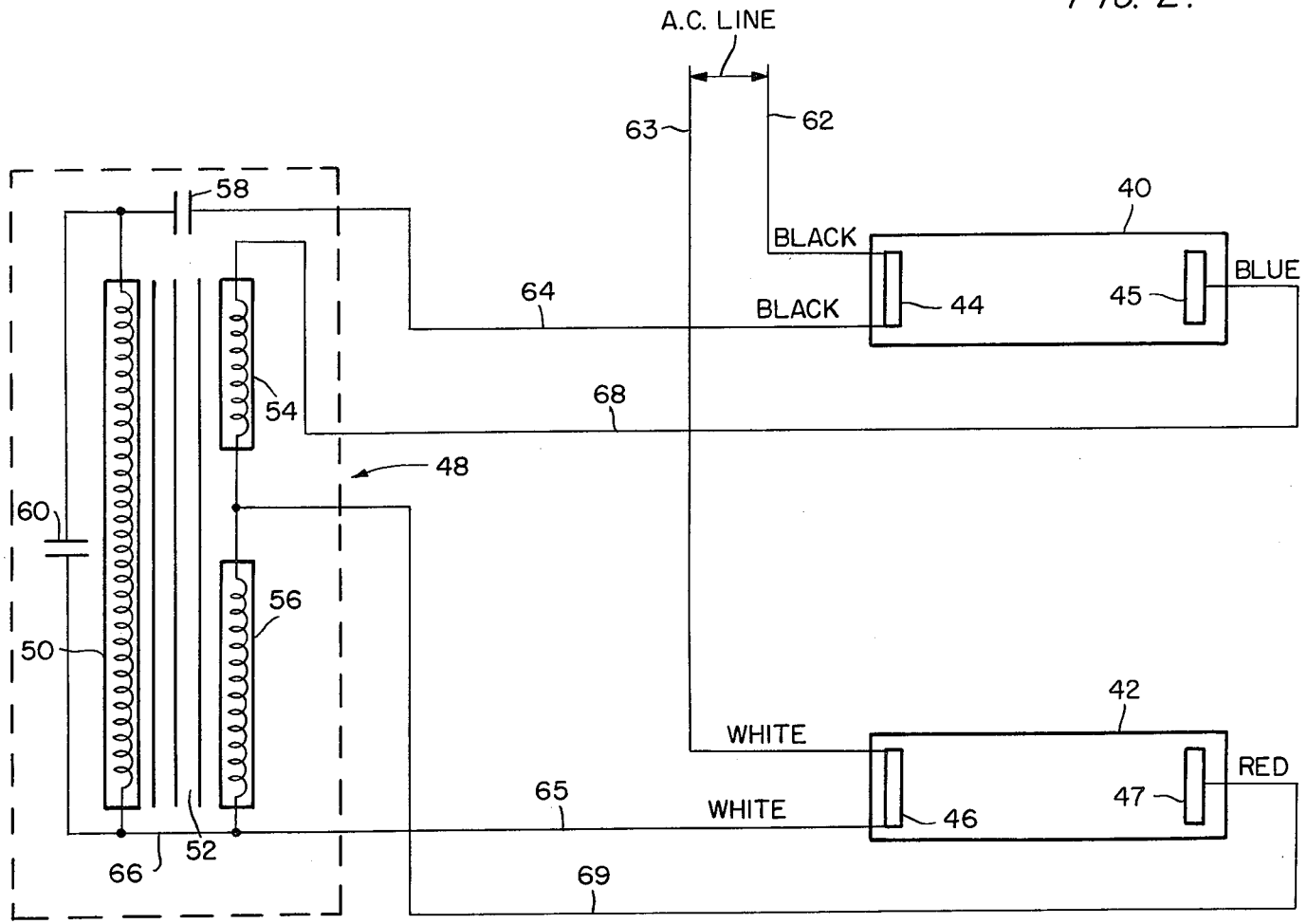
FIG. 2 is a schematic circuit diagram of another commercially available ballast connected in a different type of two lamp fluorescent lighting fixture employing instant-start type lamps.

FIG. 2 shows a typical, instant-start fluorescent lighting fixture having a pair of instant-start fluorescent lamps 40,42 having electrodes 44,45 and 46,47, respectively. It should be noted that this type of lamp does not have cathode heaters and requires a higher voltage, of the order of 800 volts, across the electrodes to discharge; such lamps are sometimes referred to as single pin or slim-line. The ballast is enclosed in a canister 48 and has a primary coil 50 surrounding a laminated iron core 52 and inductively coupled to secondary coils 54,56. A capacitor 58, in series with one end of the primary coil 50 and the electrode 44 of lamp 40, functions to provide a net capacitive reactance in the lamp circuit. A second capacitor 60 is connected in parallel across the primary coil 50. A source of conventional 60 cycle, 120 volt electrical energy is supplied via leads 62,63 to the electrodes 44 and 46, respectively, and from these via leads 64, and 65 and 66, primary coil 50 and the capacitor 58. One end of the secondary coil 56 is connected to an end of the primary coil 50 via the lead 66. The secondary coil 54 is connected via leads 68,69 in series with the two lamps 40,42. The secondary coil 54 provides a high voltage across the electrodes 45,44 to light the lamp 40 and the secondary coil 56 creates a high voltage across the electrodes 47,46 to light the lamp 42 with the lamps 40,42 operating in series. Again, with this conventional lighting arrangement, if one of the lamps fails, the other cannot discharge and so both lamps remain unlit. It should be observed that this type of ballast has only four leads extending therefrom and these have, for convenience, been marked with the color code conventionally employed by ballast manufacturers. Such a ballast is also manufactured and sold by Advance Transformer Co. and is identified by catalogue number SM-2E75-5-TP.

Attempts have been made to alter the wiring connections of the ballasts and lamps shown in FIGS. 1 and 2 in order to have only one lamp of a pair of lamps light at a time. Such alterations have been tried in lighting fixtures in commercial establishments but have been unsuccessful because the ballasts failed very quickly in an unacceptably short period. Ballast life was surprisingly drastically reduced to one to two months of normal use, whereas expected ballast life is well in excess of 20,000 hours and is usually rated as 8 years.

PREFERRED EMBODIMENTS OF THE INVENTION

The invention as applied to the conventional lighting fixtures of the types described with reference to FIGS. 1 and 2 will now be described with reference to FIGS. 3 through 7. Like parts in FIGS. 3, 4 and 5 to those in FIGS. 1 and 2 are indicated by the same reference numerals.

Figure 3:
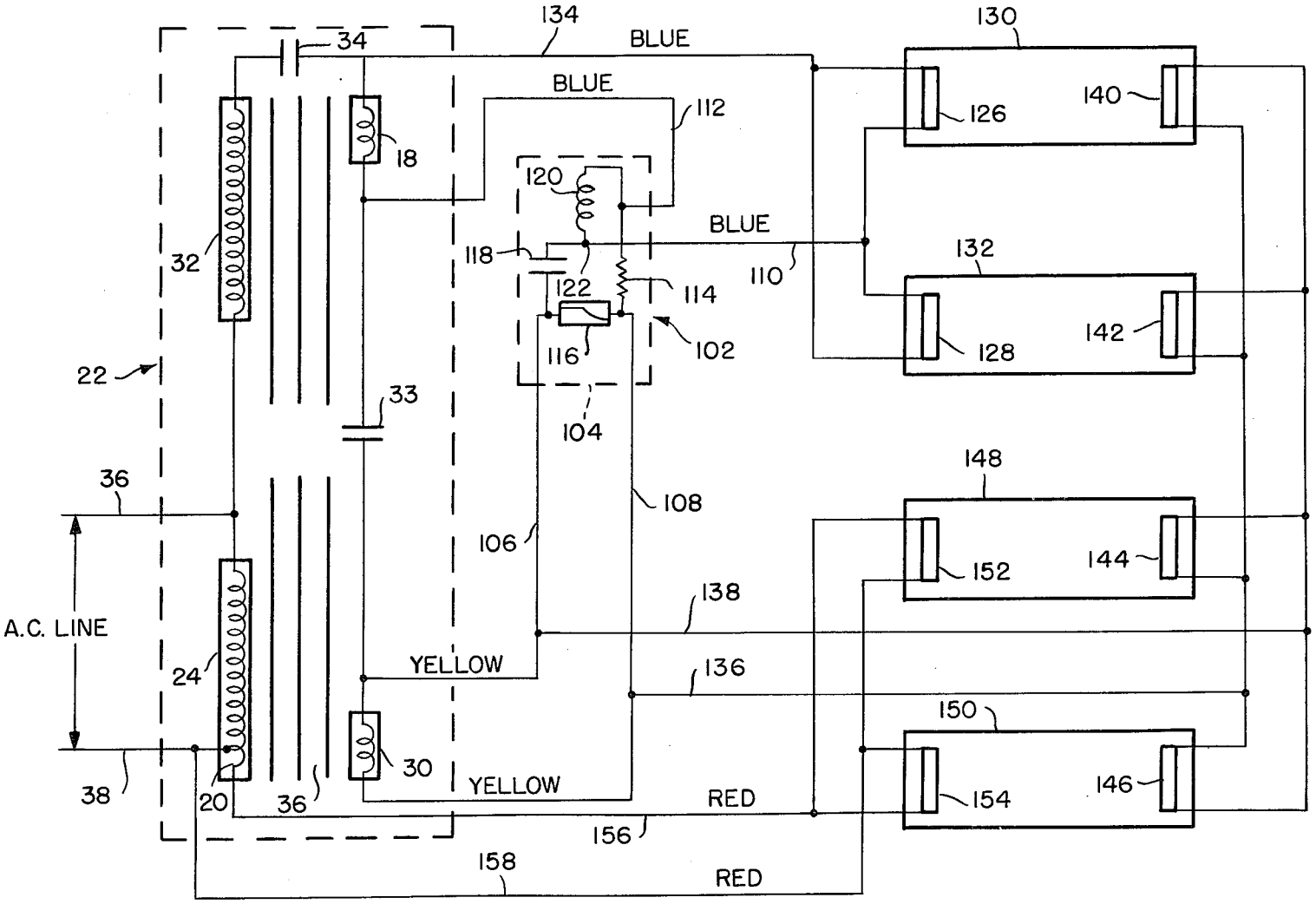
FIG. 3 is a schematic circuit diagram of a four lamp fluorescent lighting fixture employing the ballast of FIG. 1 and having connected therewith an economy device according to the invention.

FIG. 3 shows the ballast 22 of the lighting fixture of FIG. 1 connected in a four lamp lighting fixture together with an economy device 102 in accordance with the invention. This device is contained in a metal housing 104 (shown as a broken-line box) and has four leads 106, 108, 110, and 112 extending therefrom. The device has connected in series a resistor 114, a high response varistor 116, and a capacitor 118. A low inductance coil 120 completes a series circuit and is connected at one end to a node 122 adjacent the capacitor 118, and is connected at the other end to the resistor 114. The pair of leads 106,108 are connected at one end across the varistor 116 and at the other end across the secondary coil 30 of the ballast. The lead 112 is connected at one end to a node 124 in the series circuit between the induction coil 120 and the resistor 114, and at the other end to the ballast between the secondary coil 18 and the capacitor 33. The pair of leads 106,108 include the yellow leads from the ballast, and the lead 112 includes one of the blue leads from the ballast. The fourth lead 110 from the device 102 connects the node 122 to the heating elements 126,128 of a pair of rapid-start fluorescent lamps 130,132. The heating elements 126,128 are connected in parallel to the other blue lead 134 of the ballast. Leads 136,138 connect the heating elements 140,142 of the lamps 130,132 and heating elements 144,146 of the second pair of rapid-start lamps 148,150 all in parallel across the secondary coil 30. The heating elements 152,154 of the pair of lamps 148,150 are connected in parallel across the secondary coil 20 which is an extension of the primary coil 24, by the red leads 156,158 of the ballast.

In this embodiment, the induction coil 120 was 0.02H, nominal amps 0.8 A; the high response varistor was Type 2ZNR made by Panasonic with a breaking potential of 182 volts and - 2 J energy; the resistor 114 was 220 kilohms, 0.25 watts; and the capacitor 118 was 33 pf, 2 KV.

In operation, when A.C. line voltage is connected across the infeed leads 39,38 of the ballast, all the lamp cathodes are heated, but only one lamp of the pair of lamps 130,132 and one lamp of the pair of lamps 148,150 will discharge and operate in series. The other lamp of each pair will not discharge and remain unlit. The arrangement of the device 102 in the ballast circuitry allows an adequate starting voltage to start one of each pair of lamps, but immediately that one discharges there is then insufficient power available to discharge the other of that pair. The lamp of each pair that discharges depends upon the vector position of the line voltage at the instant the lighting fixture is switched on and the ballast energized. However, should the discharging lamp of a pair fail, then there is sufficient power available to automatically discharge the other lamp of that pair.

It should be noted that the varistor 116 suppresses transient surges from discharging into the secondary coil 30 which is idling. The secondary coil so idles after the lamp discharging current is established.

The induction coil 120 functions as a suppressor and in particular protects the lamp electrodes, formed by the heating elements, from high peaks. The coil 120 also increases the starting boost available. As a whole, the device 102 suppresses high voltage surges from reaching the idling secondary ballast coil 30, provides starting energy boost for the electrodes 140,142 of the lamps 130,132, and feeds back high harmonics to the idling secondary coil 30.

To more fully understand the function of the device 102, it should be realized that the electric discharge lamp fixture comprises electric circuitry consisting of inductive, capacitive and resistive impedances which together behave like an oscillatory circuit under any voltage and current changes. Consequently, the fixture's circuitry is a source of a full range of high harmonics as is any oscillatory circuit. The device 102 comprises four electrical components which collectively and individually are harmonic and short duration surge suppressors. These four components, 114, 116, 118 and 120, are connected in circuit in such a way as to short circuit the harmonics and surges. However, each component also has its own function.

The high response varistor 116, as is well known, is a flip-flop electronic component; initially it has a very high resistance, but at a voltage breaking point its resistance instantaneously drops. On switching on the lighting fixture, after the main current is established through the lamps, this main current is carried to the primary coil 24 and secondary coil 32. This causes the secondary low voltage current to secondary coil 30 to drop as a result of a weakened ballast electromagnetic field, which occurs several times in a fraction of a second. This in turn causes high voltage short duration surges and harmonics in the circuitry consisting of the secondary coil 30, lamp filaments 140,142,144,146 and their connecting leads. These harmonics and high voltage surges are normally fed back through the entire ballast inductive system, and through the idling secondary coil 30 would affect the ballast's entire system. Incorporation of the varistor 116 in parallel with the secondary coil 30 enables all these harmonics and surges to be arrested within the varistor.

The inductive coil 120 is primarily a choke feeding harmonics and surges from secondary coil 18, through the filter consisting of the capacitor 118 and resistor 114, to the varistor 116. The capacitor 118 and resistor 114 function in stabilizing the circuit; the capacitor aids suppression of high harmonics, and the resistor 114 aids suppression of high voltage short duration peaks.

Figure 4:
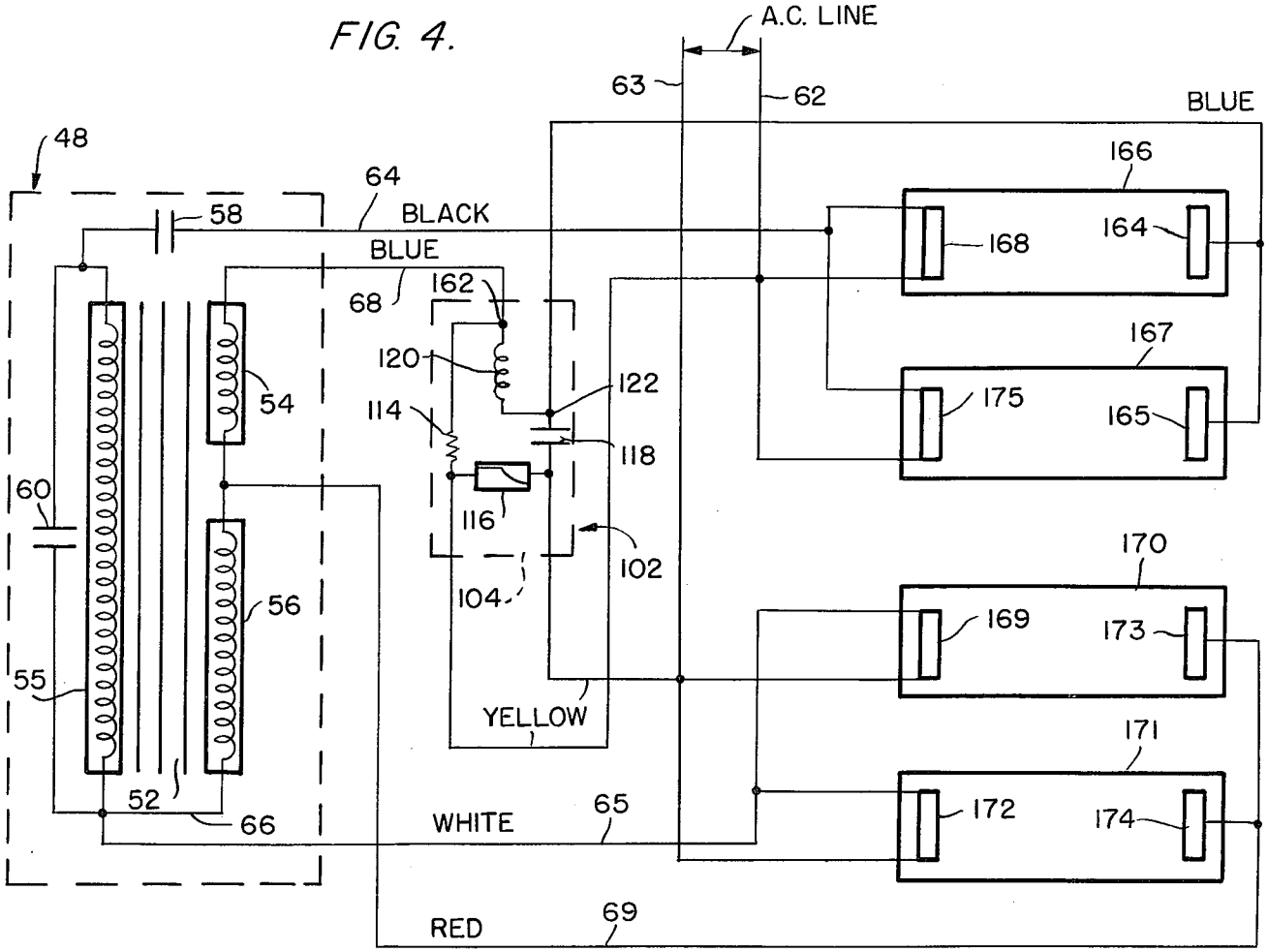
FIG. 4 is a schematic circuit diagram of another four lamp fluorescent lighting fixture employing instant-start type lamps, the ballast of FIG. 2, and having an economy device according to the invention.

FIG. 4 shows the ballast 48 of the lighting fixture of FIG. 2 connected in a four lamp lighting fixture together with the economy device 102 of FIG. 3.

The device 102 in FIG. 4 is identical to that described above with reference to FIG. 3, although the schematic representation is slightly different. All four components form a series circuit with the capacitor 118 and the resistor 114 each connected between the induction coil 120 and the high response varistor 116, but on opposite sides thereof. The inductive coil 120 has one end connected via a node 162 in this series circuit to the secondary ballast coil 54 via the blue lead 68 of the ballast 48. The node 122, between the coil 120 and capacitor 118, is connected to the electrodes 164,165 of a pair of instant-start fluorescent lamps 166,167. The varistor 116 is connected, via yellow leads of the device 102, on one side to the electrode 168 of the lamp 166, and on the other side to the electrode 169 of the lamp 170 of the second pair of instant-start fluorescent lamps 170,171.

Similar to the FIG. 2 concept, the electrodes 169 and 172 of the pair of lamps 170,171 are connected in parallel via the white ballast lead 65 to the primary coil 50 and secondary coil 56, and are also connected directly to the supply lead 63. Similarly, the electrodes 168,175 are connected to both the ballast capacitor 58 and the other supply lead 62. The remaining electrodes 173 and 174 of the lamps 170,171 are connected in parallel via the red ballast lead 69 between the secondary coils 54,56 similarly to the concept in FIG. 2. The pair of lamps 166,167 are thus connected in serial configuration with the other pair of lamps 170,171.

When the leads 62,63 are connected to A.C. line supply, one lamp in each pair will illuminate, the other in each pair remaining unlit. When the illuminated lamp of either pair 166,167 or 170,171 becomes disabled, the other lamp of that pair will automatically discharge and illuminate. The device 102 functions in the circuitry to suppress high voltage surges in the entire ballast circuit, to provide starting energy boost for the secondary coil 54, and to feed back high harmonics occurring between the lamp electrodes. The voltage across the lamps was of the order of 800 volts. The components of the device 102 had the same values as given for the device 102 of FIG. 3.

Figure 5:
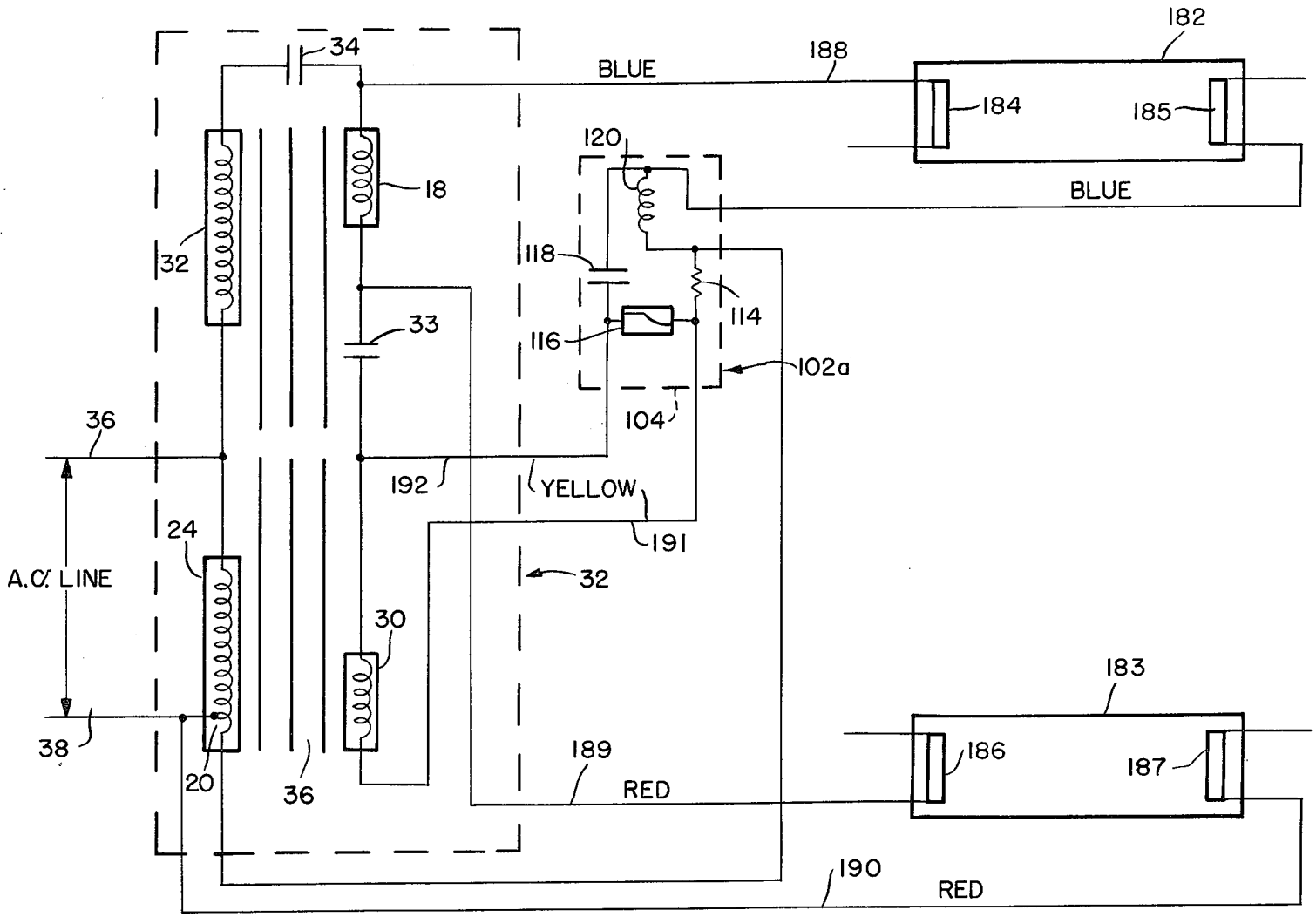
FIG. 5 is a schematic circuit diagram of the two lamp lighting fixture of FIG. 2 employing an economy device according to the invention with rapid-start lamps.

FIG. 5 shows the ballast 22 of the lighting fixture of FIG. 1 connected in a two lamp lighting fixture together with an economy device 102*a* in accordance with the invention, the device 102*a* being identical to the device 102 in FIGS. 3 and 4 although schematically represented slightly differently.

In this embodiment, two rapid-start fluorescent lamps 182,183 are connected in parallel to function as instant-start tubes with only one of the two lighting at a time and the other automatically lighting when that one becomes disabled. One side of each of the heating elements 184,185, 186,187 of the lamps 182,183 is disconnected as shown so that the heating elements will now only function as electrodes. Although the device 102*a* is exactly the same as that described in relation to FIG. 3, it is connected differently to the ballast 32 and, now, instant-start lamps 182,183. The induction coil 120 is connected to the heating element 185. The other heating element 184 of the tube 182 is connected via the blue lead 188 of the ballast to the capacitor 34. The heating element 186 of the tube 183 is connected via the other blue lead 189 of the ballast between the secondary coil 18 and capacitor 33. The remaining heating element 187 is connected via a red ballast lead 190 to the primary ballast coil 24. The yellow ballast leads 191,192 connect the high response varistor 116 across the secondary coil 30.

When the A.C. line supply is connected, one of the two lamps 182 or 183 will instantly light, depending upon the vector position of the line voltage at that instant, but then there is not sufficient power available in the other circuit to light the other lamp. However, when either lamp becomes disabled, the other will be illuminated. The voltage across the illuminated lamp is between 320 and 350 volts. High peak voltage is used to strike the lamp that illuminates, and by the arrangement of the circuitry effectively longer coils are available to provide higher voltages and the secondary ballast coil 30 idles. The device 102*a* suppresses high voltage surges from reaching the idling coil 30, provides starting energy boost for the electrode 185 of the lamp 182, and again feeds back high harmonics between the electrodes to the idling secondary coil 30.

Figure 6:
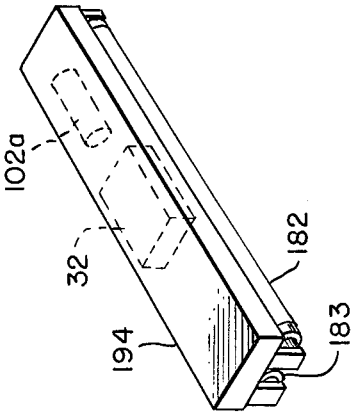
FIG. 6 is a diagrammatic perspective view of a fluorescent lighting fixture according to the invention.

FIG. 6 shows a two lamp lighting fixture in accordance with the embodiment of FIG. 5 with the fluorescent tubes 182,183 removably mounted in well known manner in a grounded metal housing 194. The ballast 32 and the economy device 102*a* are shown in broken lines separately mounted by screws inside the housing 194.

Figure 7:
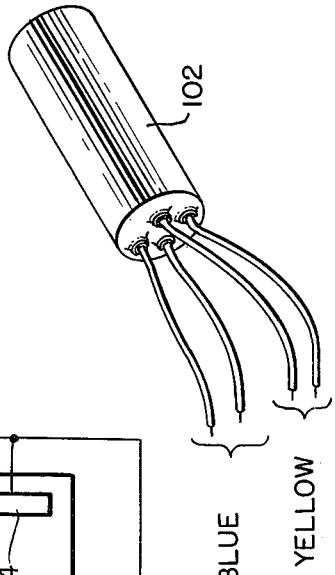
FIG. 7 is a diagrammatic perspective view of the economy device employed in FIG. 6.

FIG. 7 shows the economy device 102*a* which has an outer cylindrical canister, closed at its ends and made of metal. Through one end extends the four leads for connecting the device to the ballast and lamps, two of the leads being colored blue and the other two yellow. The series circuitry is secured tightly inside the cylindrical canister. The dimensions of the canister were 3 inches long and 1.25 inches diameter.

It will be appreciated that the economy device can readily be installed in existing lighting systems to convert them so that only one out of each pair of lamps is illuminated at a time. Also, the device can be incorporated as part of new lighting fixtures. Further, it could be incorporated with just a ballast so that the two form one unit.

With the present invention the standard ballasts need not be used to full capacity, for example, in FIGS. 3 and 5 one of the secondary coils idles and only approximately two thirds of the ballast is used. This saves energy, reduces the temperature of the ballast, and lengthens ballast life. Full ballast life of 8 years, or even longer, should be possible with these configurations.

Also, the present invention tends to extend the life of the lamps, not only because each lamp of a pair is enabled to illuminate for its full life, but by reducing flickering of the lamps while trying to start up. For example, in the configuration in FIG. 5 the rapid-start lamps are operated as instant-start lamps which increases the life of the heating filaments as they only operate as electrodes; further, as the filaments are not used for preheating, lamps with broken filaments can still be successfully used. It should now be possible for lamp life to reach the full rated 20,000 hours, instead of failing after 12,000 to 14,000 as is more normal with these lamps. Further, the elimination of flickering when the lamps are switched on contributes to further energy saving since such flickering consumes extra energy. With the present invention the lamps light instantly.

It will be appreciated, therefore, that the present invention offers a substantial saving in energy consumption for fluorescent lighting, economy in increasing the life of lamps, and a maintenance labor saving due to less frequent replacement of lamps and ballasts.

The above described embodiments, of course, are not to be construed as limiting the breadth of the present invention. Modifications, and other alternative constructions, will be apparent which are within the spirit and scope of the invention as defined in the appended claims.

What is claimed is:

1. A fluorescent lighting fixture for two pairs of lamps, comprising:

a series-type ballast having a primary coil and two secondary coils;

a series circuit comprising an inductive coil and a varistor;

the inductive coil being connected in series with one of said secondary coils and one pair of lamps;

the varistor being connected to one lamp of each pair of lamps;

the other secondary coil being connected across the other pair of lamps; and the lamps of each pair of lamps being in parallel and connected with said device and the ballast such that only one lamp of each pair is illuminated at a time, the other lamp of the pair automatically being illuminated when said one lamp becomes disabled.

2. The fixture of claim 1, wherein said series circuit includes a resistor, and a capacitor, each connected across said inductive coil and said varistor.

3. The fixture of claim 2, wherein said lamps are of the instant-start type and said series circuit suppresses high voltage surges in the ballast, provides starting energy boost for said one secondary coil, and feeds back high harmonics occurring between the electrodes of the lamps.

4. A fluorescent lighting fixture for two lamps, comprising:

a series-type ballast having a primary coil and secondary coils;

a series circuit comprising an inductive coil and a varistor;

the varistor being connected across one of the secondary coils which is connected to idle during illumination of the fixture;

the inductive coil being connected in circuit with one of the secondary coils to increase the starting boost available to one of the lamps; and the lamps being connected in parallel, and being connected with said series circuit and the ballast to function as instant-start lamps such that only one of the two lamps is illuminated at a time, the other lamp automatically being illuminated when said one lamp becomes disabled.

5. The fixture of claim 4, wherein said one lamp is connected in series with said inductive coil and said idling secondary coil.

6. The fixture of claim 4, wherein said series circuit further comprises a capacitor and a resistor.

7. The fixture of claim 6, wherein a starting capacitor is connected in series between said idling secondary coil and a second secondary coil which is connected to both lamps, and said series circuit suppresses high voltage surges, and feeds back harmonics between the lamp electrodes to said idling secondary coil.

8. A fluorescent lighting fixture having at least two lamps, comprising:

a series-type ballast having a primary coil and secondary coils;

a varistor connected across one of the secondary coils which is connected to idle during illumination of the fixture;

an inductive coil connected in circuit with one of the secondary coils to increase the starting boost available to at least one of the lamps; and said varistor and said inductive coil being interconnected with the ballast and the lamps such that only one of the two lamps is illuminated at a time, the other lamp automatically being illuminated when said one lamp becomes disabled.

9. The fixture of claim 8, further comprising a series circuit comprising said varistor, said inductive coil, a capacitor, and a resistor.

10. A device for use with a fluorescent lighting fixture having a conventional series-type ballast and at least two lamps, comprising:

a housing having four electrical connections for connecting the device to the ballast and at least one lamp;

a series circuit contained in said housing and comprising a high response varistor, an induction coil, a capacitor, and a resistor; and two of said electrical connections being internally connected across said varistor, and the other two of said electrical connections being internally connected across said coil;

whereby said device, when connected to the ballast and the lamps by means of said electrical connections with the varistor connected across a secondary coil of the ballast to make it idle and said inductive coil connected to increase the starting boost to one of the lamps, causes only one of the two lamps to illuminate at a time, the other automatically illuminating upon that one becoming disabled.

11. The device of claim 10, wherein said housing is made of metal, and said capacitor and said resistor are each connected between said varistor and said induction coil.

* * * * *